US006976339B1

(12) United States Patent
Riccio et al.

(10) Patent No.: US 6,976,339 B1
(45) Date of Patent: Dec. 20, 2005

(54) DOOR FRAME SUPPORT SYSTEM

(76) Inventors: Gabriel W. Riccio, 4355 Conrad Dr., Spartanburg, SC (US) 29301; James L. Riccio, 4652 Schirra Ct., Spartanburg, SC (US) 29301

( * ) Notice: Subject to any disclaimer, the term of this patent is extended or adjusted under 35 U.S.C. 154(b) by 148 days.

(21) Appl. No.: 10/348,734

(22) Filed: Jan. 22, 2003

(51) Int. Cl.[7] ..... E02D 35/00; E04G 21/04; A47F 5/00

(52) U.S. Cl. ..... 52/127.1; 52/127.2; 248/354.1

(58) Field of Search ..... 52/127.2, 127.1, 52/127.5, 127.6; 248/351, 354.1; 211/105.4

(56) References Cited

U.S. PATENT DOCUMENTS

| | | | | | |
|---|---|---|---|---|---|
| 350,656 | A | * | 10/1886 | Brooks | 160/293.1 |
| 2,637,555 | A | * | 5/1953 | Klaudt | 482/40 |
| 2,914,813 | A | * | 12/1959 | Christian et al. | 52/127.2 |
| 2,914,814 | A | * | 12/1959 | Christian et al. | 52/127.2 |
| 3,574,981 | A | * | 4/1971 | Henschen | 52/127.2 |
| 4,048,771 | A | * | 9/1977 | Thistlethwaite | 52/127.2 |
| 4,083,156 | A | | 4/1978 | Tye | |
| 4,304,078 | A | * | 12/1981 | Meriwether, Jr. | 52/127.2 |
| 4,560,192 | A | | 12/1985 | Wilson et al. | |
| 5,114,127 | A | | 5/1992 | Everhart | |
| 5,253,839 | A | * | 10/1993 | McClure | 248/354.1 |
| 5,340,095 | A | | 8/1994 | Eicher, III | |
| 5,377,462 | A | * | 1/1995 | Beals et al. | 52/127.2 |
| 5,622,354 | A | | 4/1997 | Chagnot | |
| 5,704,171 | A | * | 1/1998 | Ruff et al. | 52/127.2 |
| 5,853,163 | A | | 12/1998 | Chagnot | |
| 6,152,424 | A | | 11/2000 | Lapat | |
| 6,233,877 | B1 | * | 5/2001 | Monroe | 52/37 |
| 6,233,901 | B1 | * | 5/2001 | Kurfees | 52/749.1 |
| 6,247,273 | B1 | * | 6/2001 | Nickel | 52/127.2 |
| 2002/0073634 | A1 | * | 6/2002 | Bolinger et al. | 52/127.2 |

* cited by examiner

*Primary Examiner*—Peter M. Cuomo
*Assistant Examiner*—Sarah C. Burnham
(74) *Attorney, Agent, or Firm*—Leatherwood Walker Todd & Mann, P.C.; Thomas W. Epting

(57) ABSTRACT

A system for supporting a door frame, and in particular a metal door frame, during build-up of a wall about the door frame. Vertical alignment devices allow for placement of the door frame in a plumb configuration with respect to the floor and allows for fine adjustment through use of turnbuckle devices. A horizontal spreader device, also having longitudinal adjustment, provides lateral support to the door frame to reduce inward bowing of the sides of the door frame towards one another during build-up of the wall. Also, a header support device serves to maintain a parallel relationship between the header of the door frame and the threshold by compensating for sagging in the header, and also uses a longitudinal adjustment device.

2 Claims, 6 Drawing Sheets

DOOR FRAME SUPPORT SYSTEM

BACKGROUND OF THE INVENTION

This invention relates generally to a system for supporting a door frame during the installation or modification thereof.

In constructing a building, one typical means for holding a metal door frame stationary involves the precise cutting of lengths of wood, which are attached to the door frame in a manner to hold the door frame vertical. In this arrangement, the wood members must be precisely cut, and often times the wood members, having already been cut, are thrown away after use, which is wasteful. It may take two workers upwards of 45 minutes to brace the door in this manner.

Another problem arising is maintaining the sides of the door frame parallel to one another, and the header of the door frame straight, during laying of masonry against the door frame. If not properly supported, the sides of the door frame may bow inwardly, and the header may sag, due to the pressure of the masonry.

SUMMARY OF THE INVENTION

Generally, the present invention includes devices for vertically aligning a door frame, maintaining the sides of a door frame parallel to one another, and maintaining the header of the door frame parallel with the door frame threshold.

The vertical alignment device includes an elongated portion having a first end and a second end, and a foot pivotally connected to the first end of the elongated portion for rigidly attaching the elongated portion to a surface, such as a floor, wall, footer, the ground, etc. A grip is pivotally attached to the second elongated portion and is configured for slidably engaging with the door frame.

The header support device includes an elongated portion with first and second ends, a first engagement member being connected to the first end and configured for engaging the threshold. A collar is attached to the second end of the elongated portion, and a second engagement member, which engages the door frame header is attached to the collar. The collar is rotatably connected to the second end of the elongated portion and includes a threaded bore therein for allowing selective adjustment between the first and second engagement members.

The horizontal spreader device includes an elongated portion with first and second ends, with the first engagement member being connected to the elongated portion for engaging a side of the door frame. A second engagement member is also provided for contacting the opposite door frame. Interposed between the second end of the elongated portion and the second engagement member is a collar device such as used in connection with the header support, for allowing the distance between the first and second engagement members to be selectively adjusted.

The present invention also includes methods of installing and adjusting each of the vertical alignment, horizontal spreader, and header support devices.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
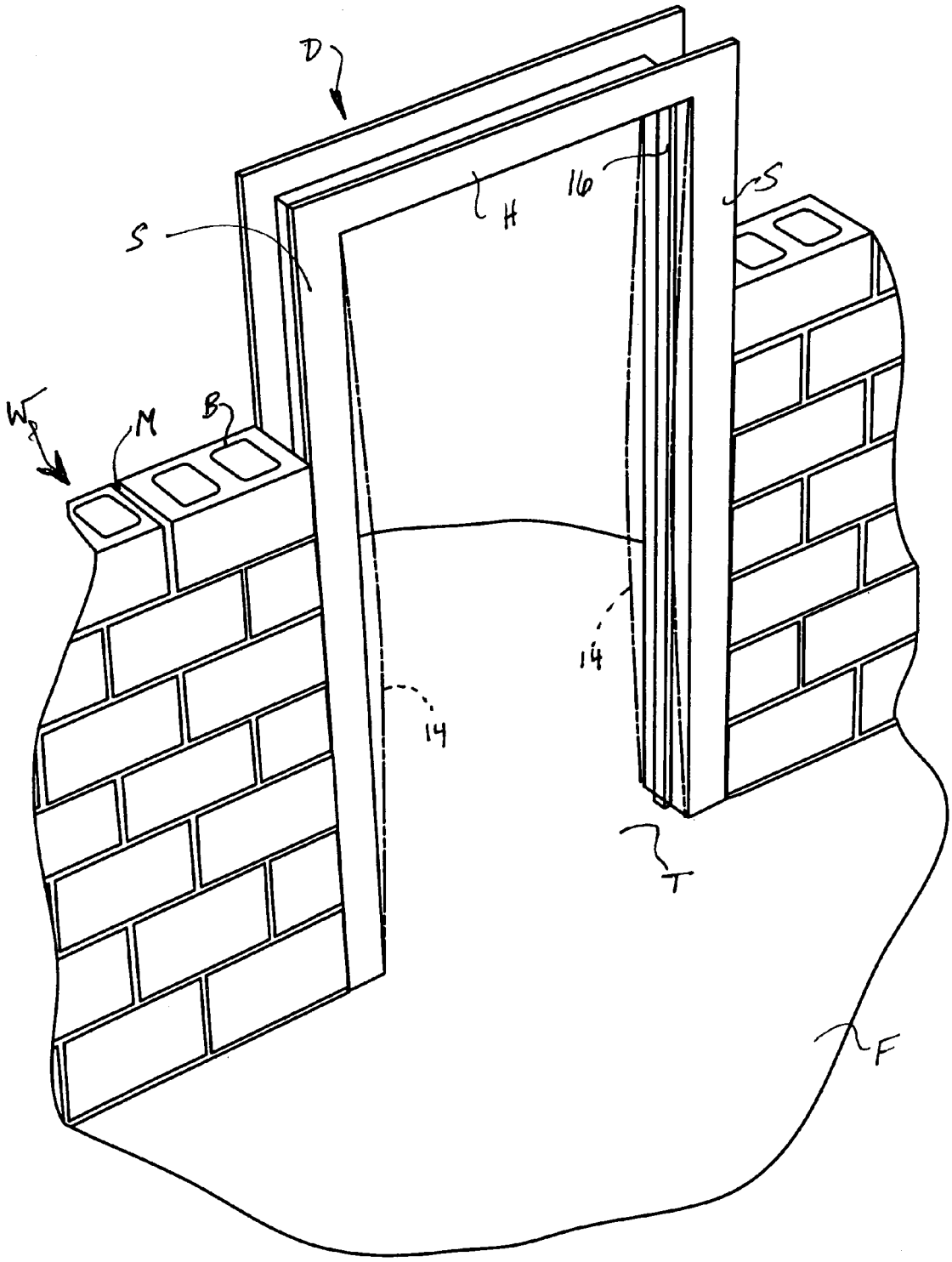
FIG. 1 is a perspective view of a typical door frame used in building construction.

The accompanying drawings and the description which follows set forth this invention in its preferred embodiment. However, it is contemplated that persons generally familiar with building construction and door frame installation and modification will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the door frame support system of the present invention is indicated generally in the figures by reference character 10.

FIG. 1 illustrates a conventional door frame, generally D, having vertically extending side portions, S, and a header portion H bridging across and connected to the upper portion of side portions S. A masonry wall, generally W, is illustrated in FIG. 1 built up about the side portions S of door frame D. As shown by phantom lines 14, side portions S may, during installation of the masonry wall W, bow inwardly if not otherwise restrained against such movement. The bowing-in of sides S of door frame D during laying of the block wall W occurs in part because of the pressure exerted on sides S by the brick or blocks B, and mortar M used in forming the masonry wall. Door frame D also includes a door stop portion 16 extending along sides S and header H.

When a door frame D is installed, the objective is to maintain the side portions S in a vertical, parallel relationship with respect to one another, and for the header portion H to be in a horizontal, parallel relationship with respect to the threshold, generally T, adjacent to or forming a part of the floor surface, generally F. These parallel relationships ensure that a door (not shown) installed in the door frame D will open and close freely without binding on the sides S or header portion H of the door frame.

Figure 2A:
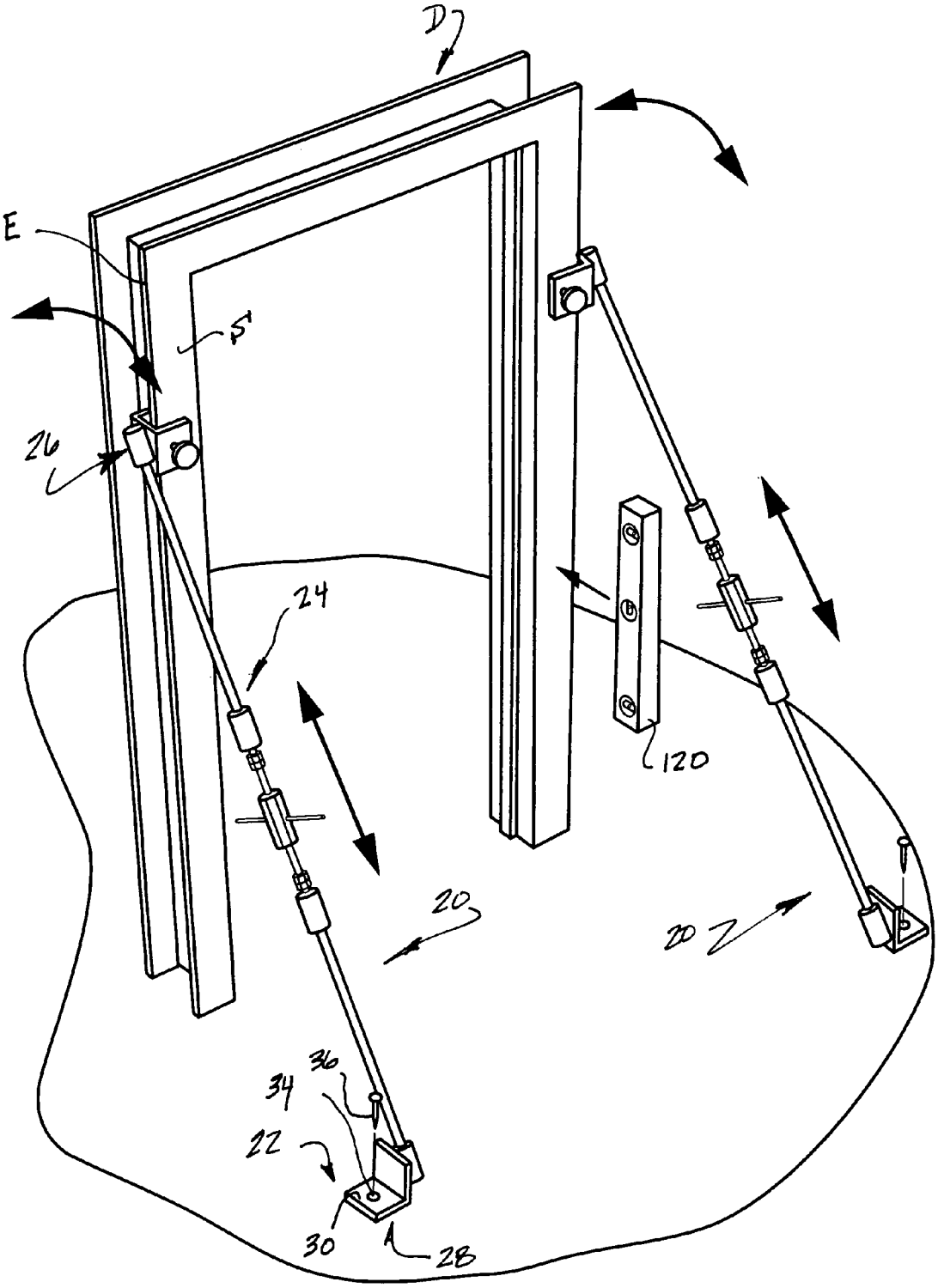
FIG. 2A is a perspective view of vertical alignment devices of the door frame support system of the present invention in use supporting the door frame shown in FIG. 1.

Turning to FIG. 2A, vertical alignment devices, generally 20, are shown, and such devices 20 form a part of door frame system 10 of the present invention. Vertical alignment devices 20 include a foot portion, generally 22, an elongated portion, generally 24, and a grip portion, generally 26. Foot portion 22 includes a bracket 28 having a flange 30. Bracket 28 defines an opening 34 through which a fastener 36, such as a nail, screw, spike, or other device can be driven for rigidly attaching the bracket to surface F. For example, if surface F is concrete, a Hilti device or TapCon fasteners may be used. For other surfaces, such means could be used, or, conventional nails, screws, bolts, the like could also be used.

Elongated portion 24 includes two struts 40, 42. Strut 40 is connected to foot 22, and strut 42 is connected to grip 26. Connected in between struts 40 and 42 is a turnbuckle device, generally 46, which allows the overall length of elongated portion 24 to be selectively varied. By varying the overall length of elongated portion 24, the distance between foot 22 and grip 26 can also be varied for use in vertically aligning and maintaining such vertical alignment in door frame D.

Through use of a vertical alignment device 20 on each side S of door frame D, the door frame may be maintained in vertical alignment across its width during construction, as a masonry wall, wood or metal studded wall, stone wall, or other type of wall is constructed around the door frame.

Figure 3A:
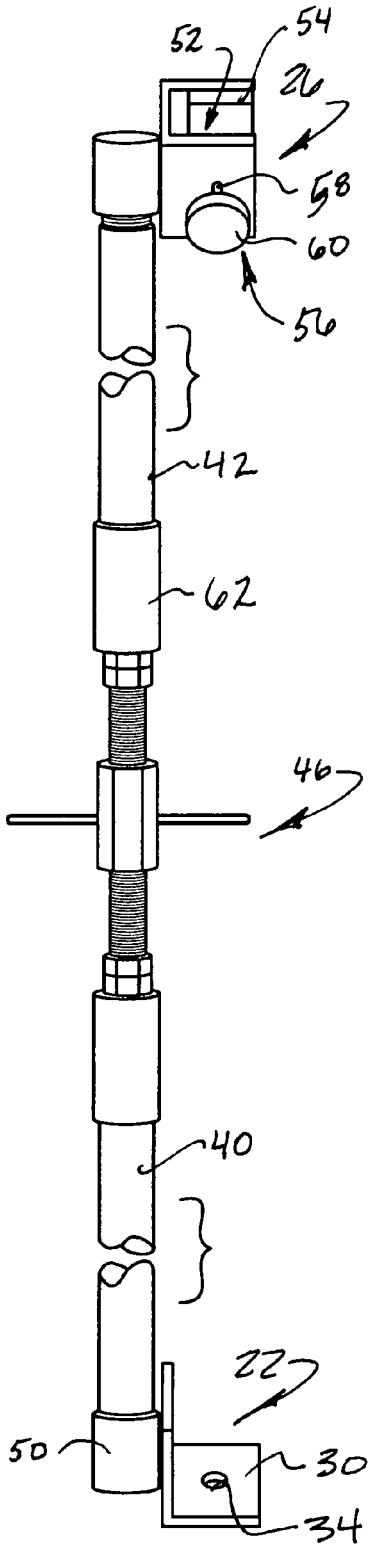
FIG. 3A is a side elevational view of a vertical alignment device constructed in accordance with the present invention.
Figure 3B:
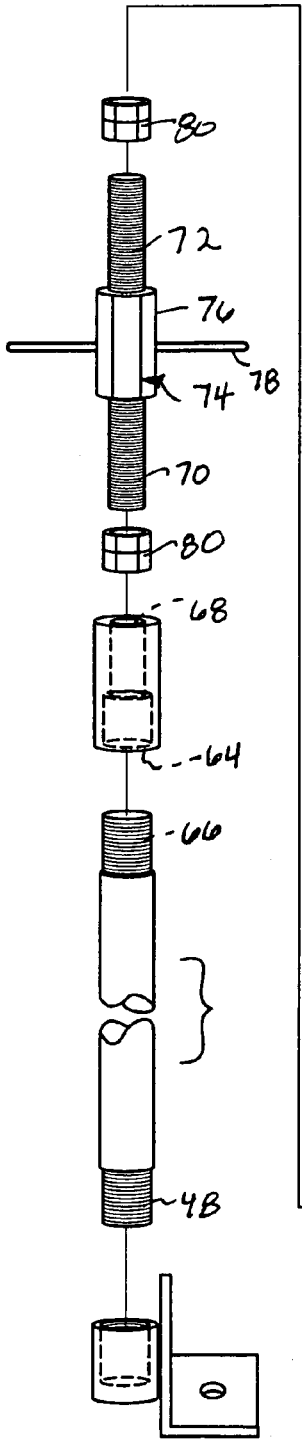
FIG. 3B is an exploded view of the vertical alignment device shown in FIG. 3A.
Figure 3B:
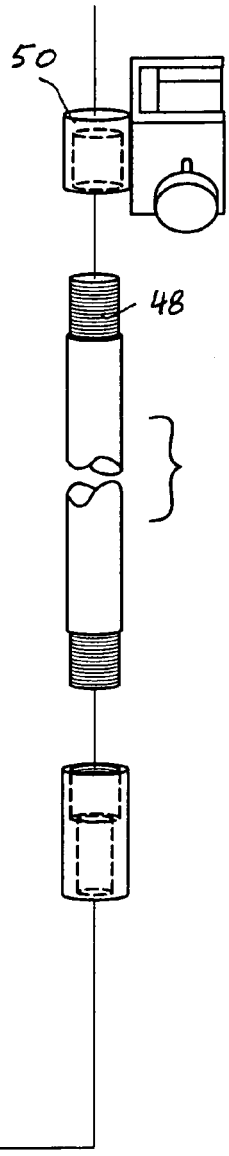

Turning to FIGS. 3A and 3B, vertical alignment devices 20 is shown in more detail. Struts 40 and 42 each have a threaded end 48 which is received by a respective sleeve 50 connected to foot 22 and grip 26. Grip 26 includes an interior profile, or channel 52, for engaging a portion of the door frame, preferably a door frame edge, or flange, E for engaging and maintaining the door frame in a vertically aligned position. Channel 52 is configured for receipt of the door frame flange E. Resilient members 54 can be provided in channel 52 to reduce scratching, marring, or other damage to the door frame during use.

A locking device, generally 56, such as a screw or bolt 58 can be used for selectively locking grip with respect to door frame D. Channel 52 of grip 26 allows for sliding movement of grip along flange E of door frame D. Once grip 26 is in the proper position, engaging flange E, grip is locked to flange E, and hence to door frame D by turning the enlarged head portion 60 of bolt 58 such that bolt 58 engages and fixes grip 26 to door frame D.

As shown in FIG. 3B, a collar 62 is threadingly connected to the end of each strut 40, 42 opposite sleeves 50. Collars 62 include a threaded bore 64 for receipt of end 66 of struts 40, 42 and also define a second threaded bore 68 for receipt of a threaded rod 70 of turnbuckle member 74. Turnbuckle member 74 includes threaded rod portions 70, 72, each being threaded in the opposite direction, such that as turnbuckle member 74 is rotated in a first direction, struts 40, 42 are moved outwardly with respect to each other. When turnbuckle member 74 is rotated in the other direction, struts 40, 42 are drawn towards one another. Turnbuckle member 74 includes an elongated hexagonal-cross section portion 76 which may be engaged by an ordinary wrench, and also includes two outwardly extending handles 78 which can be engaged by hand in order to rotate turnbuckle member 74. Jam nuts 80 are provided on threaded rods 70, 72 in order to fix rotation of threaded rods 70, 72 with respect to the collar 62 in which they are received.

Figure 2B:
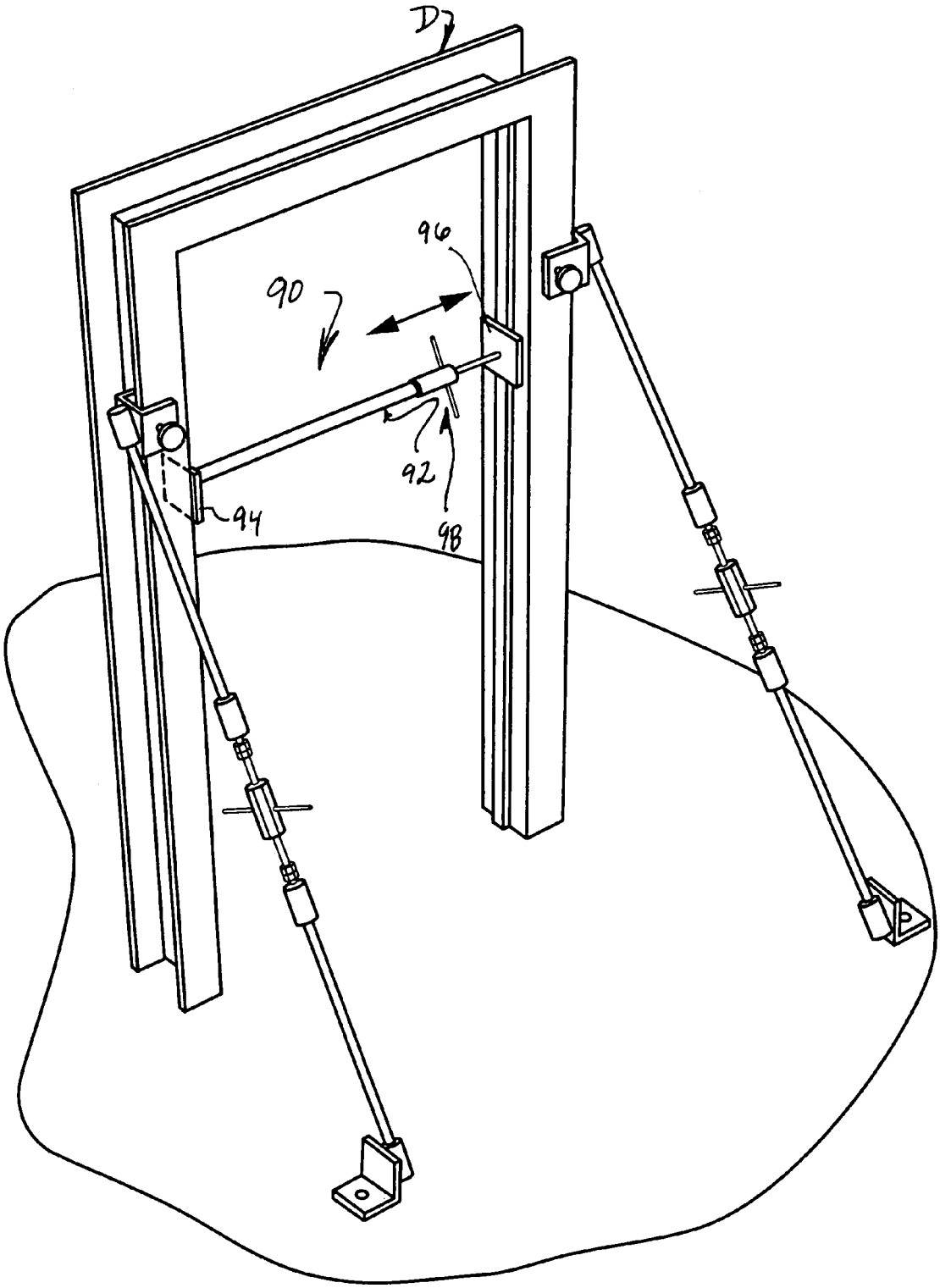
FIG. 2B is a perspective view of a horizontal spreader device of the door frame support system constructed in accordance with the present invention maintaining vertical alignment of the sides of a door frame.

Turning to FIG. 2B, a horizontal spreader device, generally 90, is shown, which is part of door frame system 10. Horizontal spreader device 90 includes an elongated portion, generally 92, having two engagement members 94, 96 for engaging side portions S of door frame D. Elongated portion 92 includes a collar device, generally 98, connected to adjustable engagement member 96 (adjustment member 94 is relatively stationary) for varying the distance between engagement members 94, 96. Horizontal spreader 90 may be used when wall portions, and particularly masonry wall portions, are built up around door frame D, and serve to reduce inward bowing of door frame sides S, as discussed above, during such wall construction.

Figure 2C:
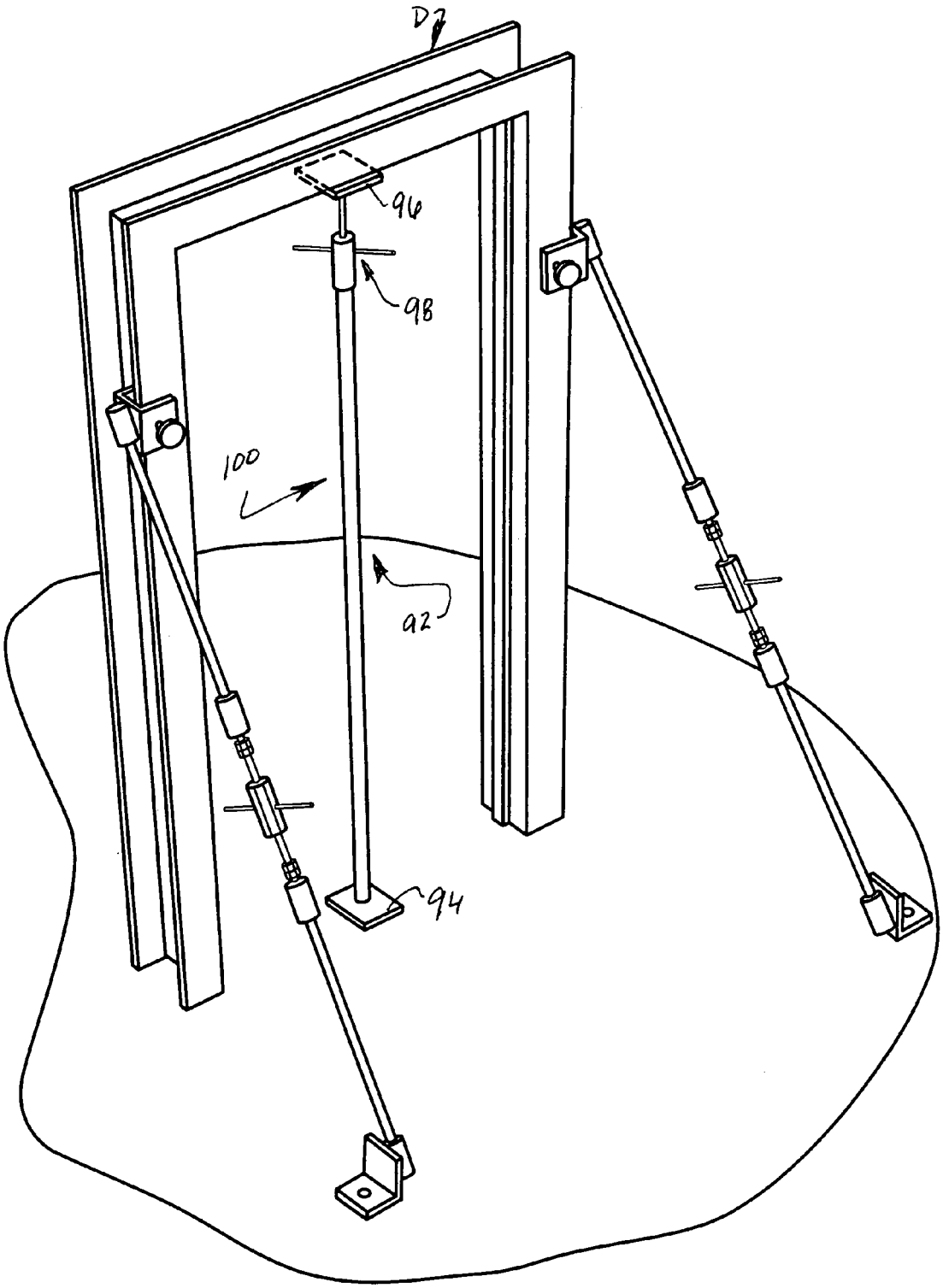
FIG. 2C is a perspective view of a header support device of the door frame support system constructed in accordance with the present invention supporting the header of a door frame.

FIG. 2C illustrates a header support device, generally 100, of door frame support system 10, which is used to reduce sagging or other misalignment of header H of door frame D during construction of a wall surrounding door frame D. Header support device 100, similarly to horizontal spreader 90, discussed above, also includes an elongated portion 92 with a collar device 98. One end of collar device 98 is connected to a generally stationary engagement member 96, and the one end of the elongated portion includes an engagement member 94. Preferably, collar device 98 is positioned against engagement member 96 such that it is convenient for use when the wall portion is built above the header. For example, if a mason is laying a masonry wall above header H, the mason will be able to readily compensates for sagging of the header simply by adjusting collar device 98 to effectively increase the distance between engagement member 96 and engagement member 94, thereby effectively increasing the overall length of elongated portion 92.

Figure 4A:
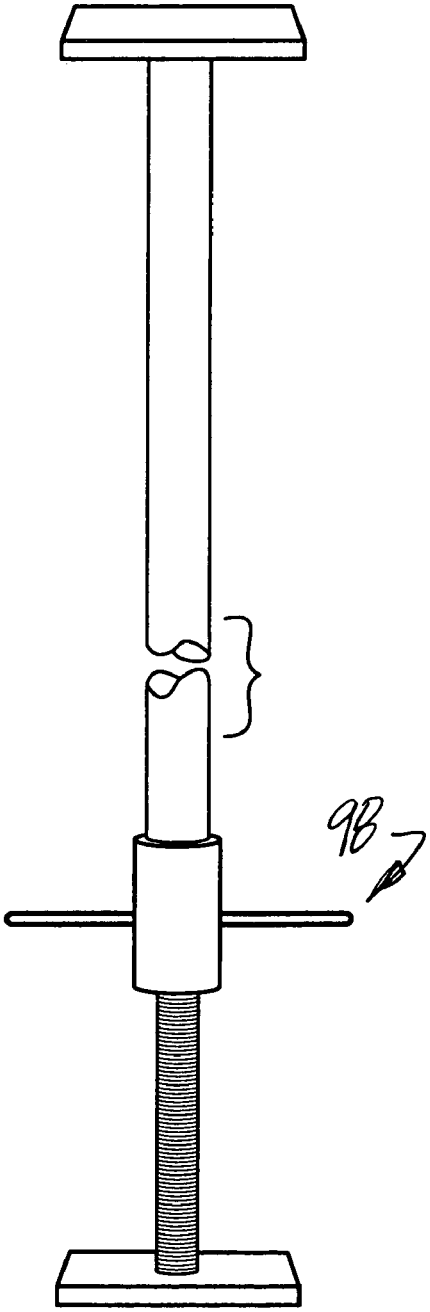
FIG. 4A is a side elevational view of a horizontal spreader/header support device constructed in accordance with the present invention.
Figure 4B:
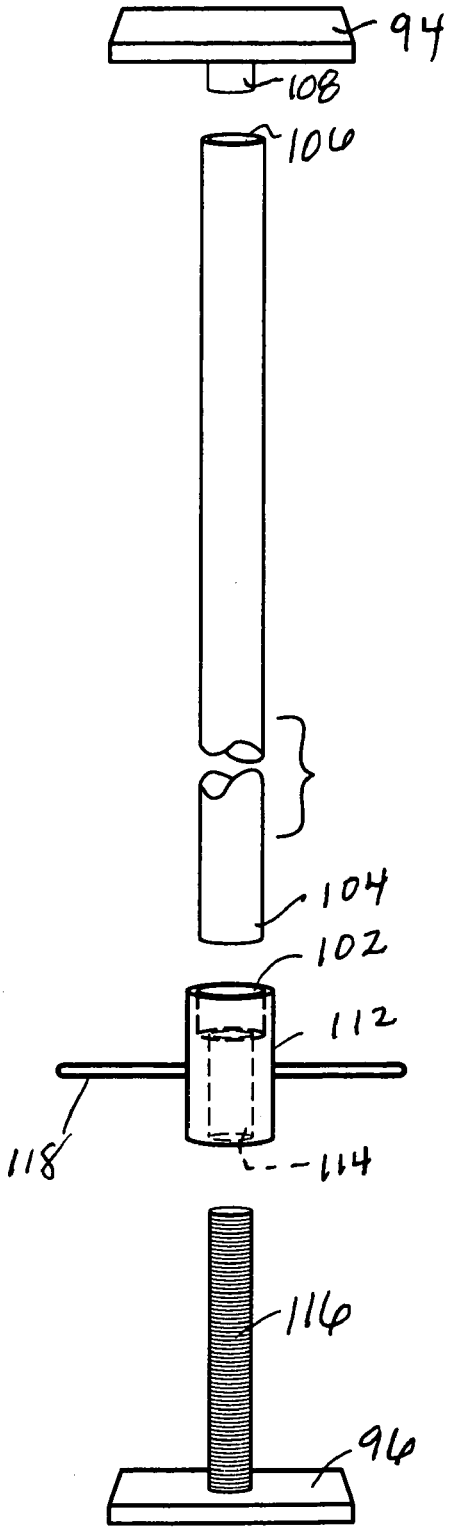
FIG. 4B is an exploded view of the horizontal spreader/header support device shown in FIG. 4A.

Turning to FIGS. 4A and 4B, a more detailed construction of horizontal spreader device 90 and header support device 100 are illustrated. As noted above, horizontal spreader device 90 and header support device 100 differ from one another, primarily, only in the overall length of elongated portions 92.

Collar device 98 used on horizontal spreader 90 and threshold support 100 includes a first bore 102 which receives the end of a strut 104. Strut 104 is essentially a tube which at one end includes a bore 106 for receipt of a post 108 connected to engagement member 94, and at the other end is received in bore 102 of sleeve 112 of collar device 98. Sleeve 112 may rotate freely with respect to strut 104. Sleeve 112 also includes a threaded bore 114 for receipt of threaded rod 116, which is fixedly attached to engagement member 96. When assembled, rotation of sleeve 112, which can be done by grasping and turning of outstanding handles 118 connected to sleeve 112, allows for the distance between engagement members 94 and 96 to selectively be varied. This is accomplished through the threaded engagement of rod 116 with threaded bore 114 of sleeve 112.

FIGS. 2B and 2C illustrate different devices of door frame system 10 being used simultaneously. For example, FIG. 2 illustrates vertical alignment devices 20 being used simultaneously with horizontal spreader device 90. This combination device would be appropriate when a wall is being built up along the sides of door frame D. FIG. 2C, which includes the vertical alignment devices 20 and header support device 100, would be appropriate when the wall is being built on top of header H of door frame D. It is to be understood, however, that other combinations of devices 20, 90, and 100 could be used as desired, and as necessary, and the present invention is not to be limited simply to the combinations illustrated in FIGS. 2A through 2C. Specifically, each of the devices 20, 90, 100 could be used singularly, and not in combination with any of the other two devices, depending on the circumstances.

A method of using door frame system 10 could involve fastening door frame D to floor surface F and using a level 120 (FIG. 2A) to ensure that the door frame is plumb with respect to the floor surface. Grip 26 is used to engage a flange E of door frame D and bolt 68 is tightened to fix grip 26 with respect to door frame D. Foot 22 is secured to the floor surface using a fastener. Using level 120, and preferably with two vertical alignment devices 20 in place, as shown in FIGS. 2A through 2C, door frame D is set plumb by adjustment of turnbuckle devices 46.

A method of using horizontal spreader device 90 could involve placing stationary engagement member 94 against either side S of door frame D and then placing adjustable engagement member 96 against the opposite side S. Horizontal spreader device 90 is adjusted and maintained in place by rotating the collar device 98 such that engagement portions 94 and 96 press outwardly on sides S of door frame D with sufficient force to support horizontal spreader device 90 in place, and also to maintain sides S of door frame D in a plumb relationship.

A method of using header support device 100 is similar to that discussed above with respect to horizontal spreader device 90. Stationary engagement member 94 could be positioned against threshold T, and the adjustable engagement member 96 positioned adjacent header H of door frame D, to allow easy access during build-up of a wall above header H. Accordingly, in the event header H begins to sag, such can be readily compensated for by rotation of collar device 98.

Devices 20, 90, and 100 are preferably constructed of steel, although aluminum or other suitable materials could be used. Portions of the devices could be welded or cast, or, if a plastic or polymer material is used, injection molded.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A device for maintaining the distance between the first and second vertical side portions of a door frame, the first and second vertical side portions each defining a front surface and a rear surface generally opposite the front surface, the device comprising:

an elongated portion having a first end and a second end;

a first engagement member for engaging the first vertical side portion of the door frame, said first engagement member being attached to said first end of said elongated portion;

said first engagement member being configured to be completely bounded between the front and rear surfaces of the first vertical side portion;

a collar rotatably connected to said second end of said elongated portion, said collar including a threaded bore therein; and a second engagement member for engaging the second vertical side portion of the door frame;

said second engagement member being configured to be completely bounded between the front and rear surfaces of the second vertical side portion;

said second engagement member having a threaded portion extending therefrom for receipt in said threaded bore of said collar, such that rotation of said collar with respect to said elongated portion allows for selective adjustment of the distance between said first engagement member and said second engagement member, for varying the distance between the first and second side portions of the door frame.

2. A system for aligning a door frame relative to a surface and for maintaining alignment between first and second vertical side portions of a door frame, the first and second vertical side portions each defining a front surface and a rear surface generally opposite the front surface, the system comprising:

a first elongated portion having a first end a and a second end;

a foot pivotally connected to said first end of said first elongated portion for rigidly attaching said first elongated portion to the surface;

a grip pivotally attached to said second end of said first elongated portion, said grip being configured to slidably engage at least one of the first and second vertical side portions of a door frame; and a second elongated portion having a first end and a second end;

a first engagement member for engaging the first vertical side portion of the door frame, said first engagement member being attached to said first end of said second elongated portion;

said first engagement member being configured to be completely bounded between the front and rear surfaces of the first vertical side portion;

a collar rotatably connected to said second end of said second elongated portion, said collar including a threaded bore therein; and a second engagement member for engaging the second vertical side portion of the door frame;

said second engagement member being configured to be completely bounded between the front and rear surfaces of the second vertical side portion;

said second engagement member having a threaded portion extending therefrom for receipt in said threaded bore of said collar, such that rotation of said collar with respect to said second elongated portion allows for selective adjustment of the distance between said first engagement member and said second engagement member, for varying the distance between the first and second side portions of the door frame.

* * * * *